US007393254B1

(12) United States Patent
Young et al.

(10) Patent No.: US 7,393,254 B1
(45) Date of Patent: Jul. 1, 2008

(54) MARINE BUOY

(75) Inventors: John Stewart Young, Vancouver (CA); Christopher T. Smith, Redhill (GB); Robert W. Williams, Richmond (CA); W. Richard Klein, Houston, TX (US)

(73) Assignee: Tideland Signal Corporation, Houston, TX (US)

( * ) Notice: Subject to any disclaimer, the term of this patent is extended or adjusted under 35 U.S.C. 154(b) by 0 days.

(21) Appl. No.: 11/676,439

(22) Filed: Feb. 19, 2007

(51) Int. Cl.
*B63B 22/00* (2006.01)

(52) U.S. Cl. ..... 441/1; 114/266

(58) Field of Classification Search ..... 114/263, 114/264, 266, 267; 441/1, 6, 11; 367/3, 367/4

See application file for complete search history.

(56) References Cited

U.S. PATENT DOCUMENTS

| | | | | | |
|---|---|---|---|---|---|
| 1,116,141 | A | * | 11/1914 | Skoldberg | 441/1 |
| 1,320,604 | A | * | 11/1919 | Dame | 441/1 |
| 2,814,055 | A | * | 11/1957 | Phillips | 441/3 |
| 2,819,476 | A | * | 1/1958 | Dodge | 441/11 |
| 2,911,658 | A | * | 11/1959 | Stanley, Jr. | 441/11 |
| 3,360,811 | A | * | 1/1968 | Bartlebaugh | 441/6 |
| 3,441,962 | A | * | 5/1969 | Williams | 441/6 |
| 3,674,225 | A | * | 7/1972 | Johnson | 441/11 |
| 3,728,749 | A | * | 4/1973 | Eby et al. | 441/1 |
| 3,916,467 | A | * | 11/1975 | Curd, Jr. | 441/28 |

* cited by examiner

*Primary Examiner*—Lars A Olson
(74) *Attorney, Agent, or Firm*—John Karl Buche; Scott Compton

(57) ABSTRACT

The present application relates to a marine buoy featuring a novel bracing assembly disposed within a marine buoy and featuring a plurality of bracing members extending between and connecting to a first fastening member and a second fastening member.

59 Claims, 4 Drawing Sheets

MARINE BUOY

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE APPLICATION

The application relates generally to marine buoys.

BACKGROUND

Marine buoys are manufactured from a broad selection of materials, in sizes and shapes appropriate to the application. Buoys encountering highly active seas tend to be of large and sturdy construction. They are generally configured to provide long range visibility and to survive the tremendous static and dynamic forces impressed upon them in open sea and inclement weather. Large, deep-water buoys of composite or plastic materials will typically have framed constructions designed to house floatable materials, with the frames designed to withstand severe environmental conditions. These frameworks are usually extremely heavy, of metal construction, and can be expensive to produce because of concern for the forces acting upon them in deep water and in a corrosive environment.

On the other hand, in more sheltered locations, buoys tend to be smaller, requiring less visual range, and having somewhat less robust construction. Unlike large buoys, small buoys are commonly constructed of lightweight materials, such as foamed materials encapsulated within a solid, or high-density plastic skin. These smaller buoys will typically have a mooring eye embedded either directly within the plastic skin or attached to a single rod element that passes through the buoy body. The mooring eye is typically attached to one end of the buoy. Use of such lightweight materials and construction methodologies is particularly advantageous because of low costs, low weights, transportability and buoyancy.

Unfortunately, in larger buoy applications, use of the above described designs and lightweight materials can result in premature failure of a buoy. This failure is often due not only to the proportionally larger acting forces placed upon the buoy, but also to the inability of a single rod element configuration to effectively distribute the forces and lateral stresses commonly encountered in more severe marine environments.

Accordingly, there is a need for a large marine buoy that can be made from one or more lightweight materials, as are typically found in smaller buoys, but that can still effectively handle and distribute the forces placed upon the large buoy design in more severe marine environments. Further, there is a need for a comparatively large marine buoy for use in severe marine environment that can be produced efficiently at moderate cost.

SUMMARY

The present application relates to a marine buoy featuring a bracing assembly disposed within a marine buoy and featuring a plurality of bracing members extending between and connecting to a first fastening member and a second fastening member. Various embodiments of the bracing assembly and buoys are provided.

BRIEF DESCRIPTION

Figure 1:
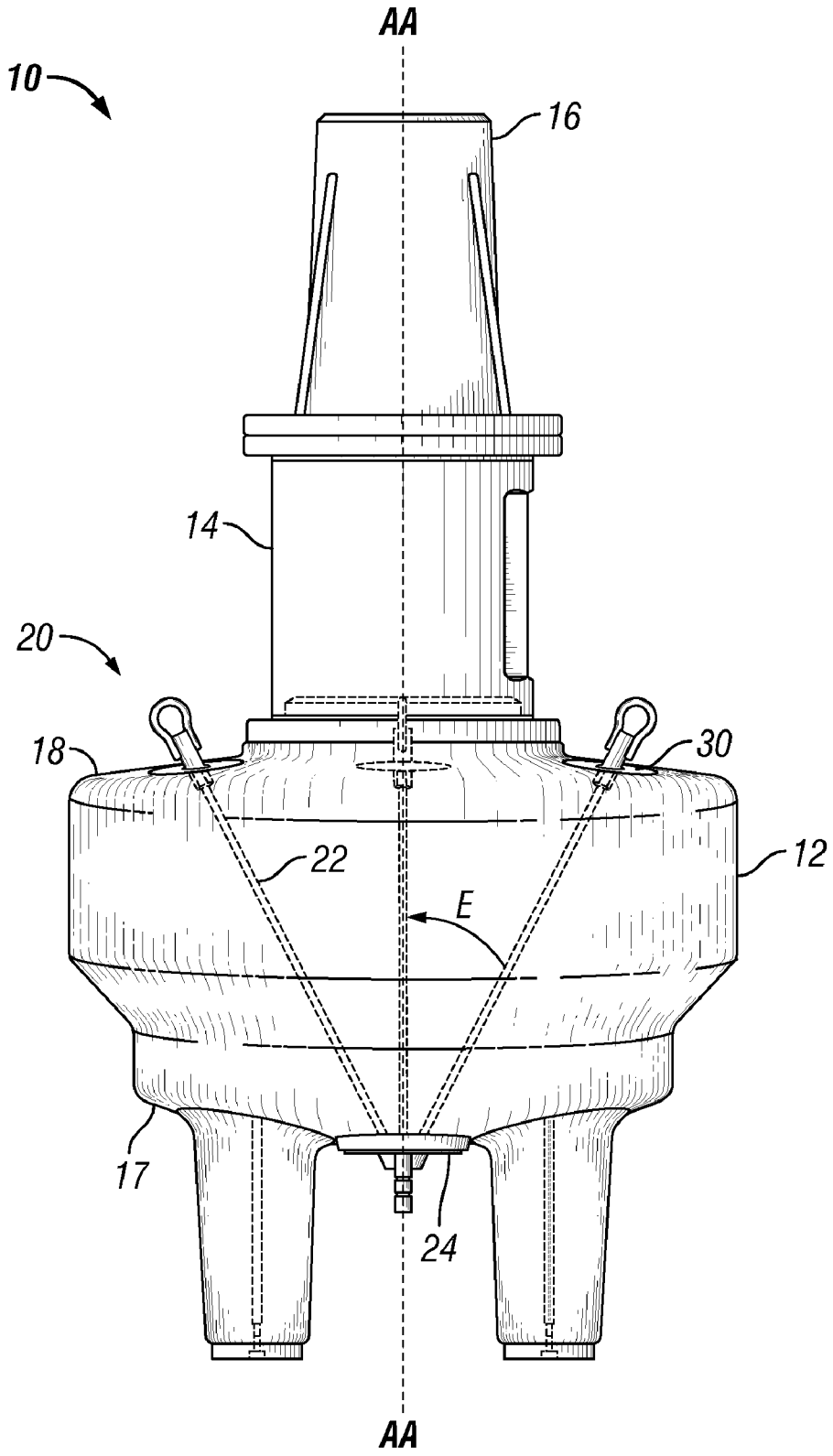
FIG. 1 illustrates a phantom side view of a large molded marine buoy having transparency for viewing inside features.

It has been found, that in a marine environment, and with suitable bracing assemblies, a large marine buoy can be manufactured from one or more relatively lightweight materials and still withstand the same forces placed on traditional large buoy designs of heavier construction in a similar marine environment. Such a desirable achievement has neither been made, nor previously considered possible; accordingly, the marine navigation buoy and method of this application measure up to the dignity of patentability and represent a patentable concept.

Before describing the invention in detail, it is to be understood that the present marine buoy and method are not limited to particular embodiments. It is also to be understood that the terminology used herein is for the purpose of describing particular embodiments only, and is not intended to be limiting. As used in this specification and the appended claims, the phrase "structurally inferior materials" or "lightweight materials" may be used periodically herein to refer to materials typically employed in smaller marine buoys. For instance, smaller buoys may benefit from construction of foam surrounded by plastic, as opposed to floatable materials housed in metal frameworks. Lightweight materials may include, but are not limited to skins having a tensile strength from about 0 kPa to about 30,000 kPa (from about 0 psi to about 4350 psi) or a material having a density equal to or less than about 1600 $kg/m^3$ (equal to or less than about 100 $lb/ft^3$.) The phrase "large buoy" or "larger buoy" refers to marine navigation buoys about 1.75 meters or more (about 5.75 ft or more) in diameter; or having an overall height above the waterline of about 2.00 meters or more (about 6.25 ft or more); or having a range of overall buoy 10 heights in the range of about 3 to about 7 meters; or having an overall weight in the range of about 400 to 3000 kilograms. The phrase "small buoy" or "smaller buoy" refers to marine navigation buoys up to about 1.75 meters (5.75 ft) in width or an overall height above the waterline less than about 2.00 meters (about 6.5 ft). The phrase "first end" may sometimes be used to refer to that lower portion of the marine buoy, or that portion that is normally underneath the surface of the water, in calm seas, during operation of the buoy in a marine environment. The phrase "second end" may sometimes be used to refer to an upper portion of that part of the marine buoy, or that is usually above the surface of the water, in calm seas, during operation of the buoy in a marine environment. The phrase "relative movement" herein refers to the shifting of one part of the buoy with respect to another part of the buoy.

In one aspect, the present application provides a large marine buoy comprised of one or more lightweight materials as opposed to known, large buoy designs. Optionally, the large marine buoy may also comprise construction with lightweight materials and have flotation produced by a relatively simple and primarily one-piece body construction.

In another aspect, the present application provides a large marine buoy comprising a float section configured to distribute stress across a greater surface area of the buoy than previously known in the art.

In another aspect, the present application provides a large buoy comprising a float section configured to distribute stress across a greater surface area of a second end of the float section than previously known in the art.

In another aspect, the present application provides a large marine buoy comprising a float section having a novel bracing assembly comprising a plurality of bracing members radially oriented within the buoy.

In another aspect, the present application provides a large marine buoy, useful for navigation or other marine purposes, comprising a float section housing a plurality of bracing members within the float section, wherein each of the bracing members is attached to a first (common) fastening member on a first end of the float section and each of the bracing members is attached to a separate fastening member on a second end of the float section. The first fastening member is operationally configured to be positioned at a plurality of points along the first end of the buoy as determined by the application of the buoy.

In another aspect, the present application provides a bracing assembly for a float section of a large marine navigation buoy, the bracing assembly being configured to distribute stress across a greater surface area of the buoy and capable of withstanding heavy environmental and sea conditions, despite lightweight construction.

In another aspect, the present application provides a method of reinforcing a large marine buoy by bracing the float section of the buoy with a plurality of bracing members, wherein each of the bracing members is attached to a first fastening member on a first end of the float section and each of the bracing members is attached to one or more second fastening members on a second end of the float section.

In another aspect, the present application provides a method to prevent the relative movement of (1) the first fastening member located on a first end of the float section and (2) the second fastening members located on a second end of the float section of a marine buoy.

In another aspect, the present application provides a method to prevent the relative movement of one or more mooring eyes attached to a first end of the float section of a marine navigation buoy.

In another aspect, the present application provides a method to prevent the relative movement of one or more lifting eyes attached to a second end of the float section of a marine navigation buoy.

The various characteristics described above, as well as other features, will now be described with reference to the accompanying drawings, wherein like reference numerals are used for like features throughout the several views. It is to be fully recognized that the different teachings of the embodiments disclosed herein may be employed separately or in any suitable combination to produce desired results.

DETAILED DESCRIPTION

Referring now to FIG. 1, a large marine buoy 10 (hereafter referred to as "buoy") is provided having a float section 12. The buoy 10 is useful in a variety of marine applications, which include but are not limited to, marine navigation, weather monitoring, communications, and intelligence gathering. In addition to the basic float section, the buoy 10 may also include an assembly of additional sections including, for example, a power source section 14 and/or a navaid section 16, wherein each of the sections 14, 16 is configured to attach to an end of the float section 12 in various stacking arrangements. Depending on the application, other functional or non-functional sectional members may also be attached to the float section 12 or sections 14, 16 as desired.

In any particular embodiment, the entire buoy 10, or at least the float section 12, or at least the outer skin of the float section 12 can be constructed of one or more lightweight materials including for example, polymeric materials (plastics), composite materials and combinations thereof. In particular, the outer skin of the float section 12 can be constructed of one or more lightweight materials, including but not necessarily limited to, those materials resistant to chipping, cracking, excessive bending and reshaping as a result of ozone, weathering, heat, moisture, and other outside mechanical and chemical influences, as well as the above mentioned marine type forces. Suitable plastics include but are not necessarily limited to polyethylene, polypropylene, polyurethane and combinations thereof. Suitable composite materials include but are not necessarily limited to fiberglass reinforced polyester, fiberglass reinforced epoxy, aramid fibers such as KEVLAR® and carbon fiber composites. Other non-metallic outer skin materials are contemplated.

Although various embodiments are contemplated, in a suitable embodiment, the float section 12 comprises at least one skin having a substantially uniform thickness from about 6.0 mm to about 18 mm (from about 0.25 inches to about 0.75 inches). In addition, the outer skin of both the float section 12 (and other buoy 10 sections) can comprise any color or combination of colors as desired. Thus, in a particularly advantageous embodiment, the float section 12 of the buoy 10 comprises a UV-stabilized polyethylene skin having a substantially uniform thickness of about 9.0 mm (about 0.35 inches) including any color or color combination as required for a particular purpose of the buoy 10.

In one embodiment, the buoy 10 is a substantially closed system, meaning that the buoy core is largely impervious to outside elements. In another embodiment, at least the float section 12 of the buoy 10 is a substantially closed system comprising at least a substantially sealable outer skin defined by an outer skin and an inner skin. As discussed further below, the float section 12 can have an empty core, or in the alternative, the float section 12 can comprise one or more filler materials disposed within the float section 12, or other section of the buoy, to form either a solid or semi-solid core inside the buoy 10. Suitable filler materials include buoyant materials that can be introduced into the buoy 10, or float section 12 to a predetermined volume to facilitate flotation or prevent water ingress in the event of damage to the float section 12. Such filler materials may include, but are not limited to, expandable polystyrene foam or other closed cell, gas expanded plastic material. In a particularly advantageous embodiment, the float section 12 is completely filled with expandable polystyrene foam. One or more filler materials may be sealably introduced into the float section 12 of the buoy 10 forming either a solid or semi-solid core within the float section 12.

The float section 12, and buoy, described herein can comprise any desired seaworthy shape. Suitable shapes include for example, cylindrical, conical and spherical shapes. In a particularly advantageous embodiment, the float section 12 comprises a quasi-cylindrical shape with at least one first end and at least one second end.

As FIG. 1 illustrates, the buoy 10 of the present application will include a bracing assembly 20. This bracing assembly 20 is suitably disposed within a float section 12 from a point along a first end of the float section 12 to a point along a second end of the float section 12. Suitably, the bracing assembly 20 is configured to distribute stress placed upon the float section 12 across the surface of both first and second ends of the float section 12. The bracing assembly 20 is comprised of at least one bracing member 22, wherein the first end of each bracing member 22 is configured to attach to a first end of the float section 12, and wherein the second end of each bracing member 22 is configured to attach to a second end of the float section 12. In most circumstances, and in normal seas, the first end of float section 12 would be submersed during buoy operation, while the second end of float section 12 would be above the water line. Suitably, the first end of each bracing member 22 attaches to a first end of the float section 12 via a first fastening member 24, while the second end of each bracing member 22 attaches to a second end of the float section 12 via separate corresponding second fastening members 30.

In other words, the bracing assembly 20 can be configured so that the bracing members 22 are radially oriented from a first fastening member 24 of the float section 12, or radially oriented around a vertical axis AA of buoy 10. In a particularly advantageous embodiment, the attachment point of each bracing member 22 to the first fastening member 24 may be closer to the vertical axis AA of the buoy 10 than the attachment point of each bracing member 22 to the second fastening members 30. As seen in FIG. 1, and further in FIG. 2A, the bracing assembly may suitably define an inverted cone or pyramid shape, with each of the bracing members 22 defining an angle E relative to a vertical axis AA of the buoy 10. Such an angle E of the bracing members 22 relative to the buoy vertical axis AA may be in the range of from about ten to about ninety degrees. Applicant has found one suitable selection of angles between the vertical axis AA and the bracing members 22 to be in the range of about 10 to about 70 degrees. The angles between the vertical axis AA and separate bracing members 22 may or may not be the same. In fact, the angles may vary depending on the location of the first fastening member 24 on the buoy 10 and the point of attachment of the separate bracing members 24 to the first fastening member 24.

In this application, various forms of bracing members 22 are contemplated. In one embodiment, the bracing members 22 can include circular rods, semi-circular rods, or multi-sided rods and other combinations of flat sided and curved sided rods contemplated by those of ordinary skill in the art. In another embodiment, the bracing members 22 can include elongated tapered members, or rods with intermediate shapes or structures attached thereto. In still another embodiment, the bracing assembly 20 can comprise any combination of the bracing members 22 discussed above.

Suitably, the bracing members 22 can attach to the first and second fastening members 24, 30 by a variety of attachment means, including for example, various fastening type fixtures such as threaded connections, locking pins, welds, screws, hinged devices and swivel devices, depending on the type of bracing member 22 incorporated into the buoy 10. In a particularly advantageous embodiment, the bracing members 22 include threaded circular rods configured to fasten to threaded entries located on both the first fastening member 24 and the second fastening member 30. In an even more advantageous embodiment, the first end of each bracing member 22 includes right hand threads and the second end of each bracing member 22 includes left hand threads configured to fasten to corresponding threaded holes on fastening members 24 and 30, respectively.

Each of the bracing members 22 can include equal lengths, or in the alternative, the bracing members 22 can include dissimilar lengths. The length of any particular bracing member 22 may depend on (1) the attachment point of the bracing member 22 on both the first and second ends of the float section 12, or (2) the shape and dimensions of the innermost wall of the float section 12 and shape and dimensions of the outermost wall of the float section 12 at both the first end and second end of the float section 12.

The bracing members 22 are typically made from materials strong enough to withstand the most extreme mechanical stresses and the most severe marine and saline environments. Suitably, the bracing members 22 are made from corrosion-resistant materials having high axial tensile strength. In a particularly advantageous embodiment, the bracing members 22 comprise a tensile strength of about 138 kPa or more (about 20,000 lb/in$^2$ or more). In addition, the bracing assembly 20 can incorporate bracing members 22 of like construction, or in the alternative, the bracing members 22 can be made from dissimilar materials having the qualities mentioned above. Suitable bracing member 22 materials include for example, metals, composite materials, and combinations thereof. Suitable metals include, for example, high carbon steel, low carbon steel, stainless steel, aluminum, aluminum alloys, iron, iron alloys, and combinations thereof. Other suitable metals and alloys are contemplated and will be appreciated by those skilled in the relevant arts. Suitable composite materials include, for example, glass fiber reinforced polyester, glass fiber reinforced epoxy, carbon fiber composite, and combinations thereof. Other suitable composites are contemplated and will be appreciated by those skilled in the relevant arts.

In one embodiment of the bracing assembly 20, the first fastening member 24 can be suitably configured to (1) securely, releasably, and/or sealably attach to a first end of the float section 12, and/or be configured to (2) securely and/or releasably receive a first end of each bracing member 22. In addition, the second fastening members 30 can be configured to (1) securely, releasably, and/or sealably attach to a second end of the float section 12, and to (2) securely and/or releasably receive a second end of bracing members 22. Depending on the shape of the float section 12 used, each of the fastening members 24, 30 can be fastened to either a substantially horizontal or substantially vertical wall of the float section 12 in relation to the surface of the water. The float section 12 can be sealed at each of the fastening members 24 and 30 by various means, including but not necessarily limited to (1) compressing the outer skin of the float section 12 to fastening members 24 and 30, and/or (2) sealing the float section 12 by applying one or more sealants to the fastening members 24 and 30, and/or (3) coating the inner surface of the fastening members 24 and 30 with a plastic, and/or (4) bonding a sealing layer to the inner surface of the float section 12, and combinations thereof.

Various means may be used to secure first 24 and second 30 fastening members to the buoy 10. In one embodiment, each of the fastening members 24, 30 may comprise a sandwich type assembly having at least two substantially parallel plate members placed along at least part of the outermost skin and innermost skin of the float section 12. In this arrangement, the fastening members 24, 30 may be operationally configured to sandwich one or more skins of the float section 12 therebetween the plate members. Suitably, the substantially parallel plate members are joined by bolts (through the one or more skins of the buoy 10), which may be connected to the innermost parallel plate member(s) through holes, or suitably blind holes, effectively sealing the fastening members 24, 30 and float section 12 at each of the bolt connections against intrusion of external environmental influences, such as seawater and the like.

Other second fastening members 30 are contemplated. For instance, in another embodiment, the deck 18 (FIG. 2B), or other uppermost section of the second end of the float section 12, may comprise a continuous ring type member configured to securely or releasably receive a second end of each bracing member 22.

As described above, the first fastening member(s) 24 and the second fastening member(s) 30 may include a plurality of attachment means or fastening means for receiving the first and second ends of the bracing members 22, determined by the type of bracing members 22 used. In one suitable embodiment, the attachment means includes a configuration wherein at least part of the fastening members 24, 30 (1) extends beyond the innermost wall of the float section 12 a predetermined distance, and/or (2) extends beyond the outermost wall of the float section 12 a predetermined distance, and/or (3) receives the bracing members 22 at a predetermined depth within the fastening members 24, 30, so that the ends of the bracing members 22 terminate at a point either within, about equal to, or beyond the outermost wall of the float section 12. In a particularly advantageous embodiment, fastening members 24, 30 have a configuration wherein each of the fastening members 24, 30 suitably includes a length greater than the thickness of the float section 12 skin(s) wherein at least part of each fastening member 24, 30 extends beyond both the innermost skin and the outermost skin of the float section 12, and wherein the ends of each bracing member 22 may terminate beyond the outermost skin of the float section 12.

In yet another embodiment, the attachment means of fastening members 24, 30 comprise threaded entries configured to receive threaded circular rods. In a particularly advantageous embodiment, the threaded entries comprise a depth effective (1) to provide adequate strength to the bracing assembly 20 under tension and (2) to avoid shearing off of either the interior or exterior threads at their base during operation of the buoy 10. In a particularly advantageous embodiment, each threaded entry has a depth of at least about 37.5 mm (about 1½ in). In addition, each thread entry suitably lies near a center of the attachment means of the fastening members 24, 30. A central location of each of the thread entries is effective for minimizing excessive torque on the ends of the threaded circular rods, which torquing can lead to unwanted flexion of the threaded circular rods during operation of the buoy 10.

Figure 2A:
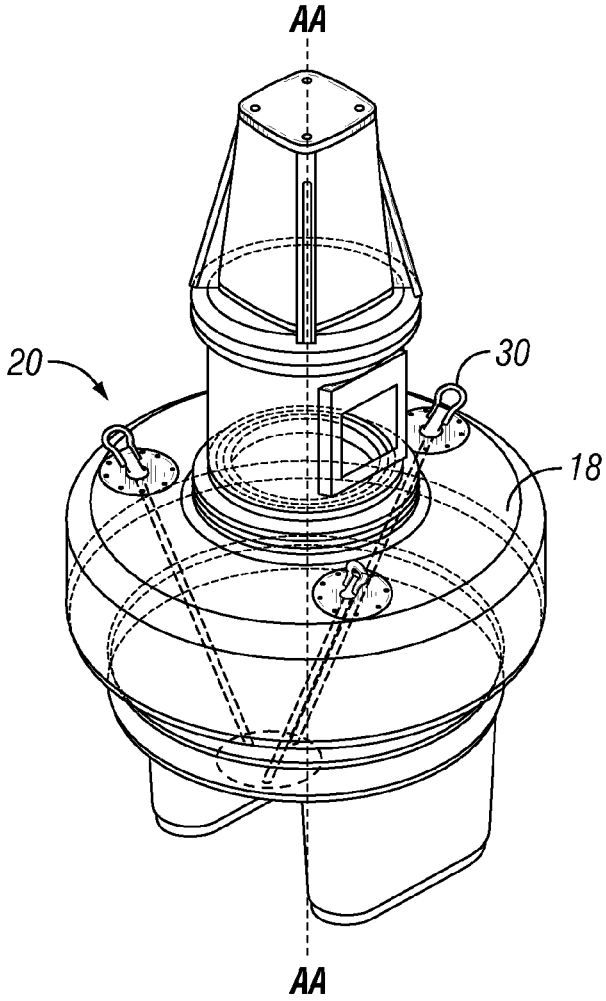
FIG. 2*a* illustrates a phantom perspective view of a large marine buoy having transparency for viewing inside features.
Figure 2B:
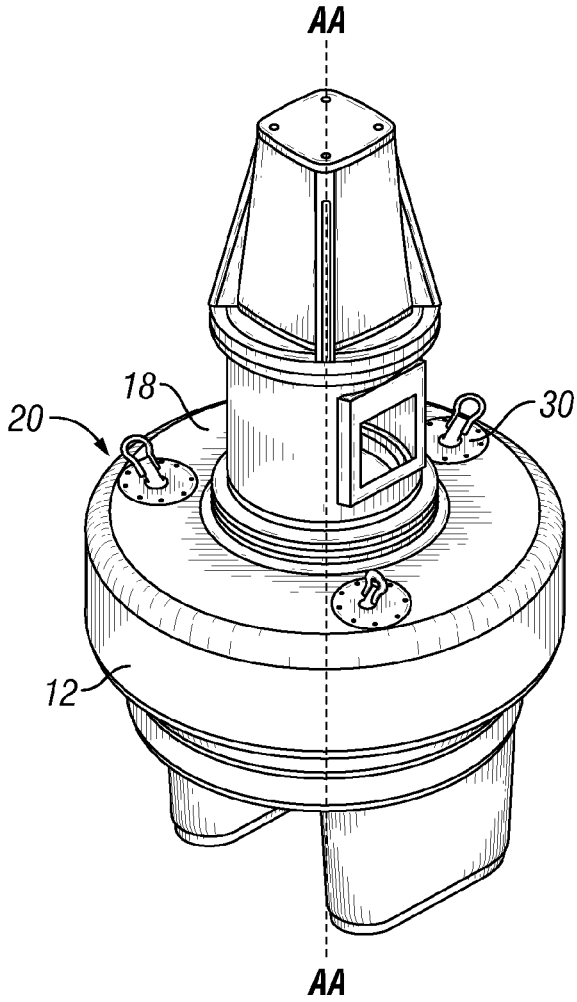
FIG. 2*b* illustrates a perspective view of a large marine buoy including the outer skin of the float section of the buoy.
Figure 3A:
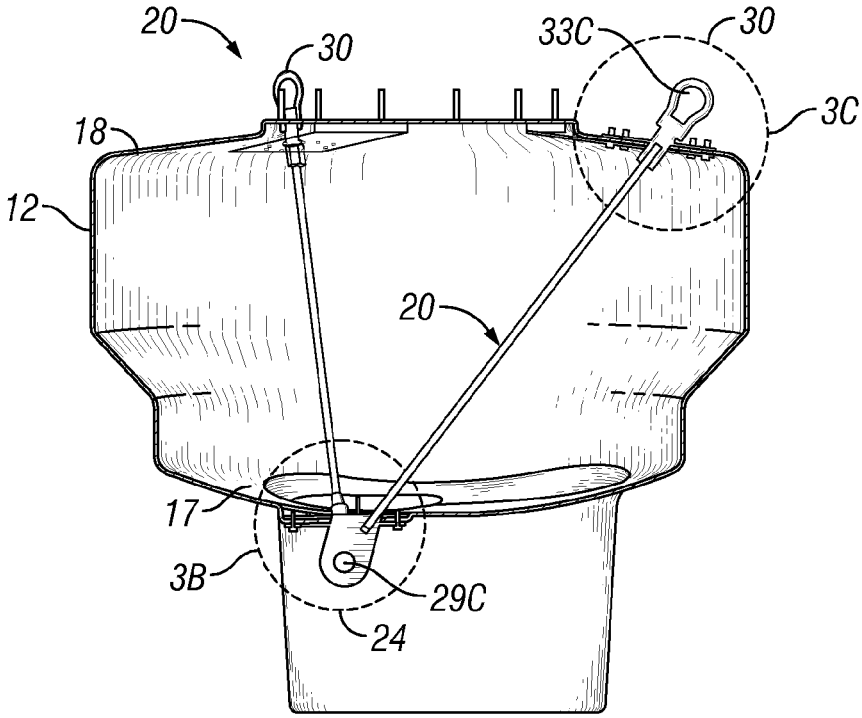
FIG. 3*a* illustrates a phantom side view of a float section of a large marine buoy having transparency for viewing a bracing assembly.
Figure 3B:
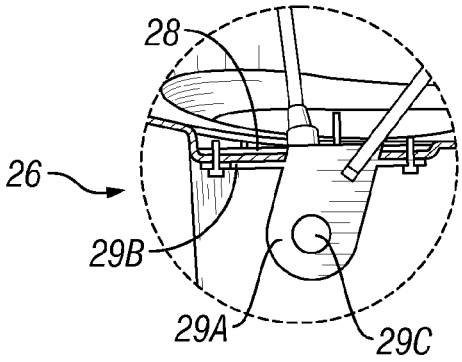
FIG. 3*b* illustrates a view of one embodiment of a first fastening member.
Figure 3C:
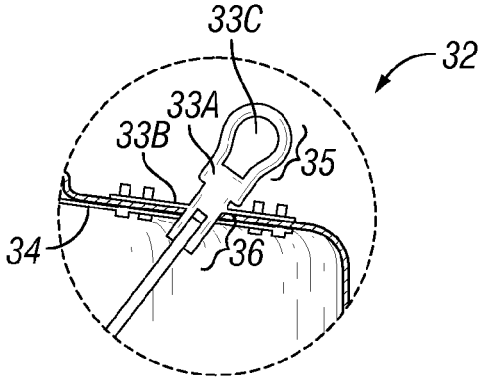
FIG. 3*c* illustrates a view of one embodiment of a second fastening member.
Figure 4:
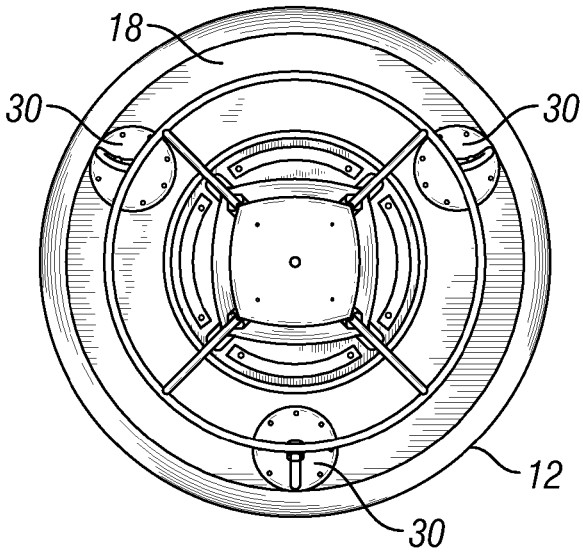
FIG. 4 illustrates a top view of the float section of a large marine buoy.

A variety of bracing assembly 20 constructions and fastening member 24, constructions may be used. For instance, as illustrated in FIGS. 3A-3C, one suitable embodiment of a float section 12 is shown to include a bracing assembly 20 having three bracing members 22, a first fastening member 24 including one or more mooring eyes 29*c*, and three separate second fastening members 30 each of which may or may not include one or more lifting eyes 33*c*. Suitably, the fastening members 24, 30 are attached to substantially horizontal parallel surfaces of the float section 12 as depicted in FIGS. 2A, 2B and 3A. As illustrated in FIG. 3A, the first fastening member 24 is attached to a ballast surface 17 of the float section 12, and the three separate second fastening members 30 are attached to a deck 18 of the float section 12. In this embodiment, the first fastening member 24 may include a mooring eye assembly 26 and may be operationally configured to sandwich the skin of the float section 12 therebetween. In particular, the mooring eye assembly 26 suitably includes a main body 29A and a plate member 29B configured to run substantially parallel to a backing 28 for sandwiching the float section 12 skin(s) therebetween. As shown in FIG. 3B, at least part of the main body 29A may extend into the core of the float section 12 for suitable releasable or fixed attachment to the bracing members 22. Suitably, the main body 29A may comprise one or more threaded holes for receiving the bracing members 22. In addition, the main body 29A may include one or more mooring eyes 29C therethrough, depending on the application.

Now turning to FIG. 3C, and a suitable second fastening member 30, each of the second fastening members 30 may optionally include a lifting eye assembly 32. Such a lifting eye assembly 32 may also include a back plate 34. Also, the second fastening members 30 may be operationally configured to sandwich one or more skins of the float section 12 between a back plate 34 and plate 33B. In a similar manner as the mooring eye assembly 26 described above, the second fastening member 30 may include a main body 33A and a plate 33B configured to run substantially parallel to the back plate 34 for sandwiching the one or more float section 12 skins therebetween. Suitably, the plate 33B and the back plate 34 can vary in surface area resulting in a direct correlation between the surface area of the second fastening members 30 and the ability of each to distribute stress along the second end of the float section 12, or across any surface where they may be located. Thus, the greater the surface area of the plate 33B and the back plate 34, the more effective the second fastening members 30 are at distributing stress along the second end of the float section 12, or wherever they may be secured.

The main body 33A may suitably comprise an exterior section 35 and an interior section 36 configured to extend into the core of the float section 12 for suitable releasable, or fixed attachment to a particular bracing member 22. Suitably, the interior section of the main body 33*a* comprises a substantially centrally located threaded hole for receiving a second end of a bracing member 22. The exterior section of the main body 33*a* can include one or more lifting eyes 33*c* therethrough depending on the application. In the embodiment as provided in FIG. 3*a*, each fastening member 24, 30 can be assembled from its individual parts and connected through the one or more skins of the float section 12 by bolts, or other fastening means known to those of ordinary skill in the art.

Typically, buoys placed in marine environments are exposed to one or more forces, including lateral stresses, and cyclical linear tension along the line of the mooring eye assembly 26 of the buoy 10. In general, the stresses imposed upon the buoy 10 increase as the second to third power of the buoy diameter and the forces acting upon the mooring eye assembly 26 are not, of necessity, collinear with any tension element between the mooring eye assembly 26 and the second end of the float section 12. Thus, in order to manufacture and use a buoy 10 comprising at least a float section 12 made from one or more lightweight materials, a bracing assembly 20 configuration, as described herein is necessary for preventing relative movement between the mooring eye assembly 26 and the second end of the float section 12.

The configuration of the bracing assembly 20 (i.e., the point of attachment of the fastening members 24, 30 along the float section 12 and the point of connection of each bracing member 22 to the fastening members 24, 30) for any one application can be determined by any number of factors including, but not necessarily limited to, the diameter of the float section 12, the height of the float section 12, the shape of the float section 12, the amount of cyclical linear tension acting on the mooring eye assembly 26, and the amount of stress impressed upon the float section 12 in a marine environment. Thus, in one embodiment, float section 12 can be configured so that the first fastening member 24 can be positioned at any point along the first end of the float section 12 depending on one or more of the above listed factors. Or in the alternative, the first fastening member 24 can be adjusted from a first attachment position to at least a second attachment position along the first end of the float section 12 depending on one or more of the above listed factors, while each of the separate second fastening members 30 remains fixed in its first attachment position to the float section 12. In an embodiment of the buoy 10 where the first fastening member 24 includes one or more mooring eye assemblies 26, the first fastening member 24 can be configured so that the one or more mooring attachment points of the mooring eye assemblies 26 to the first fastening member 24 can be positioned along the vertical axis AA of the buoy 10, or in the alternative, at positions either upstream or downstream of the vertical axis AA of the buoy 10, and depending on the position of the first fastening member 24 and one or more of the above listed factors.

Figure 5:
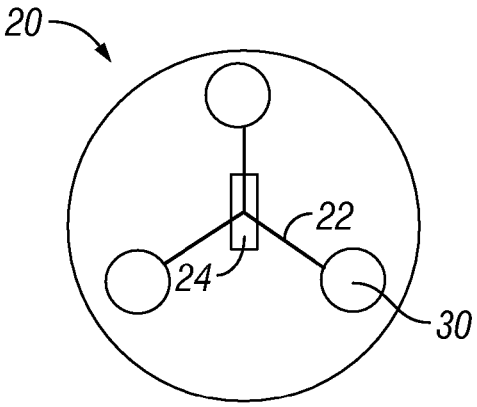
FIG. 5 illustrates a top view of a simplified bracing assembly configuration at zero current.
Figure 6:
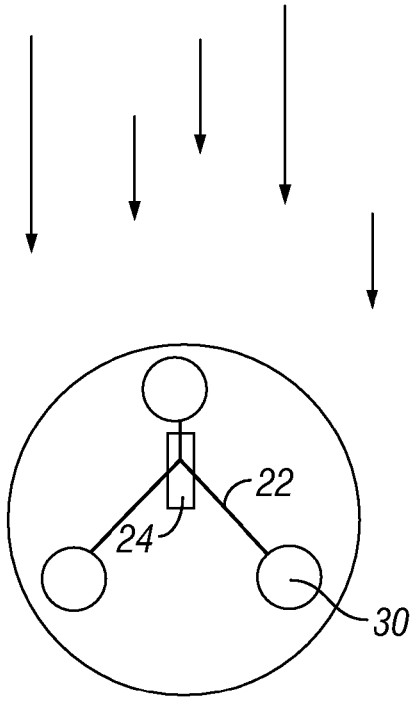
FIG. 6 illustrates a top view of a simplified bracing assembly configuration at a current greater than zero.

The present application contemplates use of buoys 10 in conditions where currents may vary. Therefore, in low current conditions, a mooring attachment of the first fastening member 24 may be located along or near the vertical axis AA of the buoy 10. However, in conditions where the current is greater than zero (FIG. 6), the first fastening member 24 may also be configured to include one or more mooring attachment points located upstream of the vertical axis AA of the buoy 10—as shown in a simplified illustration in FIGS. 5-6. FIG. 6 represents a buoy 10 in current conditions, and shows how forces acting on the buoy 10 are more evenly distributed across the buoy based on the relative positions of the first fastening member 24 and the second fastening members 30. A similar arrangement is also depicted in FIG. 3A, where the first fastening member 24 is positioned upstream of the vertical axis AA of the buoy 10. In a particularly advantageous embodiment, the first fastening member 24 is positioned upstream of the vertical axis AA of the buoy 10, from about one-sixth to about one-fourth of the diameter of the float section 12. Depending upon the current acting on the buoy 10, adjustments may be made to the buoy construction to maintain the most suitable position or attitude of the buoy 10. Adjustments may suitably be made so that the vertical axis AA of the buoy 10 will be maintained substantially perpendicular to the horizon. Suitable adjustments may be made based on the locations and types of fastening members 24, 30, and the suitable locations on the buoy 10 of these devices.

Based on the bracing assembly 20 configurations, bracing assembly 20 materials, and float section 12 dimensions and materials mentioned above, a buoy 10 described herein including an overall height above the waterline of about 3 to about 4 meters (about 9½ ft to about 13 ft) and diameter of about 1.75 to about 3.0 meters is disclosed and also effective for use in marine conditions comprising currents up to about 6 knots. Overall the buoys 10 disclosed herein are typically large, having a typical overall height of about 3 to 7 meters (9.8 to 23 ft.). They also typically have an overall gross weight of about 400 to 3000 kg. (880 to 6600 pounds); and an overall diameter of about 1.75 to about 3.0 meters (5.75 to 9.8 ft.).

The invention will be better understood with reference to the following non-limiting example, which is illustrative only and not intended to limit the present invention to a particular embodiment.

EXAMPLE 1

In one non-limiting example, the marine navigation buoy comprises the following approximate dimensions:

| | |
|---|---|
| Buoy Height | |
| second section (power source) 14: | 1.12 meters |
| third section (navaid) 16: | 1.16 meters |
| Float Section Height: | 1.89 meters |
| Float Section Outer Diameter: | 2.20 meters |
| Float Section Volume: | 3.64 meters$^3$ |
| Float Section Wall Thickness: | 12.5 mm |
| Float Section Skin Material: | Polyethylene |
| Deck Diameter: | 2.2 meters |
| Bracing Assembly: | |
| first 24and second 30 fastening members, dimensions including: | |
| Inner Diameter of mooring eye: | 50 mm |
| Inner Diameter of Lifting eye: | 100 mm |
| backing diameter: | 355 mm |
| backing thickness: | 12.5 mm |
| plate member diameter: | 355 mm |
| plate member thickness: | 19 mm |
| back plate diameter: | 355 mm |
| back plate thickness: | 19 mm |
| plate diameter: | 355 mm |
| plate thickness: | 25 mm |
| Depth of threaded holes on both mooring eye and lifting eye assemblies: | 44 mm (min) |
| Inner Diameter of threaded holes of each: | 25.4 mm (1 inch-8 thd/in.) |
| Bracing member (rod) Outer Diameter: | 25 mm |
| Bracing member materials (ex: steel): | 316 Stainless Steel |
| fastening member 24, 30 materials: | 316 Stainless Steel |
| Filler material: | Expanded foam Polystyrene |
| Upstream position of the common first fastening member from the vertical axis AA of the buoy: | (254 mm; about 10 inches). |
| Location of the center of each attachment means for each second fastening member on the deck from the vertical axis | 334 mm (13.2 inches) |
| Total weight of buoy: | 1790 kg (3940 lb) |
| Total weight of float section including ballast: | 1658 kg (3648 lb) |

Disclosed is a bracing assembly for a float section of a marine navigation buoy comprising: a plurality of bracing members within the float section; a first fastening member at one end of the float section; at least one second fastening member at another end of the float section; wherein a first end of each bracing member is attached to the first fastening member and a second end of each bracing member is attached to a second fastening member. Further disclosed a bracing assembly wherein at least the float section is constructed of one or more lightweight materials. Further disclosed is a bracing assembly wherein the attachment point of each bracing member to the first fastening member is closer to the vertical axis of the buoy than the attachment point of each bracing member to the second fastening members. Further disclosed is a bracing assembly wherein the attachment point of each bracing member to the first fastening member is closer to the vertical axis of the buoy than the attachment point of each bracing member to the second fastening members. Further disclosed is a bracing assembly wherein each of the bracing members is radially oriented from the first fastening member. Further disclosed is a bracing assembly of claim wherein each of the bracing members is radially oriented from the first fastening member. Further disclosed is a bracing assembly wherein the first fastening member is attached to a first end of the float section and the second fastening members are attached to a second end of the float section. Further disclosed is a bracing assembly wherein the point of attachment of the first fastening member along the float section is adjustable from a first position to at least a second position. Further disclosed is a bracing assembly wherein the point of attachment of the first fastening member along the float section is adjustable from a first position to a second position. Further disclosed is a bracing assembly wherein the first fastening member further comprises one or more mooring eye assemblies attached to the first fastening member and including one or more mooring attachment points. Further disclosed is a bracing assembly wherein the first fastening member further comprises one or more mooring eye assemblies attached to the common fastening member and including one or more mooring attachment points. Further disclosed is a bracing assembly wherein the one or more mooring attachment points are adjustable. Further disclosed is a bracing assembly wherein the one or more mooring attachment points are adjustable. Further disclosed is a bracing assembly wherein the one or more mooring attachment points are located upstream of the vertical axis of the buoy in marine conditions where the current is greater than zero. Further disclosed is a bracing assembly wherein the one or more mooring attachment points are located upstream of the vertical axis of the buoy in marine conditions where the current is greater than zero. Further disclosed is a bracing assembly wherein the float section includes one or more skins defined by an inner wall and an outer wall. Further disclosed is a bracing assembly wherein the buoy is a one piece molded buoy. Further disclosed is a bracing assembly wherein the bracing members are selected from the group consisting of circular rods, semi-circular rods, multi-side rods and combinations of flat sided and curved rods. Further disclosed is a bracing assembly wherein each of the fastening members comprises a sandwich type assembly configured to sandwich the one or more skins therebetween. Further disclosed is a bracing assembly wherein the bracing members are selected from the group consisting of circular rods, wires, cables, semi-circular rods, multi-side rods and other combinations of flat sided and curved sided rods. Further disclosed is a bracing assembly wherein the separate fastening members are evenly distributed across the second end of the float section. Further disclosed is a bracing assembly wherein the separate fastening members further comprise one or more lifting eye assemblies attached to the separate fastening members. Further disclosed is a bracing assembly wherein the one or more lightweight materials are selected from the group consisting of plastics, composite materials and combinations thereof. Further disclosed is a bracing wherein the float section comprises one or more filler materials. Further disclosed is a bracing assembly wherein the buoy comprises an overall height above the waterline of about 3 to about 5 meters. Disclosed is a marine buoy comprising: a float section; a bracing assembly within the float section, the bracing assembly including a plurality of bracing members, a first fastening member attached to a first end of the float section, and separate fastening members attached to a second end of the float section; the first end of each bracing member being configured to attach to the first fastening member and the second end of each bracing member being configured to attach to a second fastening member; wherein the first fastening member is adapted to be positioned at a position along the first end of the buoy. Further disclosed is a buoy wherein the float section is constructed of one or more lightweight materials. Further disclosed is a buoy wherein each of the bracing members is radially oriented from the first fastening member. Further disclosed is a buoy wherein the float section comprises one or more filler materials. Further disclosed is a buoy wherein the attachment point of each bracing member to the first fastening member is closer to the vertical axis of the buoy than the attachment point of each bracing member to the second fastening members. Further disclosed is a buoy wherein the ends of each bracing member terminate at a point beyond the float section. Further disclosed is a buoy wherein the float section comprises at least one skin including a substantially uniform thickness from about 6.0 mm to about 18 mm. Further disclosed is a buoy wherein the float section comprises at least one skin including a substantially uniform thickness of about 9.0 mm. Further disclosed is a buoy wherein the one or more lightweight materials are selected from the group consisting of plastics, composite materials and combinations thereof. Further disclosed is a buoy wherein the plastic is selected from the group consisting of polyethylene, polypropylene, polyurethane and combinations thereof. Further disclosed is a buoy wherein the plastic is a UV-stabilized polyethylene. Further disclosed is a buoy wherein the composite material is selected from the group consisting of fiberglass reinforced polyester, fiberglass reinforced epoxy, aramid fibers, and carbon fiber composites. Further disclosed is a buoy wherein the first fastening member further comprises a mooring eye assembly. Further disclosed is a buoy wherein the bracing members are made from materials selected from the group consisting of metals, composite materials and combinations thereof. Disclosed is a method for distributing stress placed upon a second end of a float section of a molded marine buoy, the method comprising the following steps: providing a bracing assembly including a plurality of bracing members, a first fastening member, and separate second fastening members for distributing stress across a second end of a float section of a marine buoy; attaching the separate second fastening members at various points along the second end of the float section; and attaching the first fastening member at a point along the first end of the float section closer to the vertical axis of the buoy than the attachment point of the second fastening members along the second end of the float section whereby each of the bracing members is radially oriented within the float section from the first fastening member to separate fastening members. Further disclosed is a method further comprising distributing the second fastening members across the second end of the float section. Further disclosed is a method further comprising increasing the surface area of the second fastening members as the stress placed upon the float section increases. Disclosed is a method of securing a mooring eye assembly and a plurality of lifting eye assemblies to a float section of a marine buoy, the method comprising the steps of: providing a bracing assembly including a plurality of bracing members within the float section, a first fastening member including a mooring eye assembly attached to a first end of the float section, and second fastening members each including a lifting eye assembly attached to a second end of the float section, wherein the common fastening member is attached to the first end of the float section at a point closer to the vertical axis of the buoy than the attachment point of each second fastening member to the second end of the float section; attaching a first end of each bracing member to the mooring eye assembly; and attaching a second end of each bracing member to a separate lifting eye assembly. Further disclosed is a method further comprising distributing the separate fastening members across the second end of the float section. Further disclosed is the method further comprising positioning the first fastening member upstream of the vertical axis of the buoy from about one sixth to about one fourth of the diameter of the float section. Disclosed is a large marine buoy comprising: a float section constructed of UV-stabilized polyethylene; a filler material forming a core within the float section; a plurality of threaded rods radially oriented within the float section from a first end of the float section to a second end of the float section; a first fastening member attached to a ballast surface of the float section; and a plurality of second fastening members attached to a deck of the float section; wherein each of the threaded rods is configured to fasten to the first fastening member at a first end and configured to fasten to a second fastening member at a second end. Disclosed is a marine buoy comprising: a bracing assembly disposed within said marine buoy; said bracing assembly featuring a plurality of bracing members extending between and connecting to a first fastening member and a second fastening member. Further disclosed is a marine buoy wherein said bracing members are rods. Further disclosed is a marine buoy wherein said bracing assembly defines an inverted cone or pyramid. Further disclosed is a marine buoy wherein said bracing members define an angle relative to a vertical axis of the buoy in the range from about 20 to about 80 degrees. Further disclosed is a marine buoy further comprising construction with lightweight materials. Further disclosed is a marine buoy further comprising a filler material surrounded by a skin. Further disclosed is a marine buoy wherein said buoy is a large buoy. Further disclosed is a marine buoy of wherein said buoy is large, being at least 1.75 meters or greater in diameter. Further disclosed is a marine buoy wherein said buoy is large, having an overall height of at least 2.00 meters.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

We claim:

1. A bracing assembly for a float section of a marine navigation buoy comprising:

a plurality of bracing members within the float section;

a first fastening member at one end of the float section;

at least one second fastening member at another end of the float section;

wherein a first end of each bracing member is attached to the first fastening member and a second end of each bracing member is attached to a second fastening member, and wherein the attachment point of each bracing member to the first fastening member is closer to a vertical axis of the buoy than the attachment point of each bracing member to the second fastening member.

2. The bracing assembly of claim 1, wherein at least the float section is constructed of one or more lightweight materials.

3. The bracing assembly of claim 2, wherein the first fastening member further comprises one or more mooring eye assemblies attached to the first fastening member and including one or more mooring attachment points.

4. The bracing assembly of claim 3, wherein the one or more mooring attachment points are adjustable.

5. The bracing assembly of claim 4, wherein the one or more mooring attachment points are located upstream of the vertical axis of the buoy in marine conditions where a current is greater than zero.

6. The bracing assembly of claim 2, wherein each of the bracing members is radially oriented from the first fastening member.

7. The bracing assembly of claim 2, wherein the float section includes one or more skins defined by an inner wall and an outer wall.

8. The bracing assembly of claim 7, wherein each of the fastening members comprises a sandwich type assembly configured to sandwich the one or more skins therebetween.

9. The bracing assembly of claim 8, wherein the first and second fastening members further comprise one or more lifting eye assemblies attached to each fastening member.

10. The bracing assembly of claim 2, wherein the buoy is a one piece molded buoy.

11. The bracing assembly of claim 10, wherein the bracing members are selected from the group consisting of circular rods, semi-circular rods, multi-side rods and other combinations of flat sided and curved rods.

12. The bracing assembly of claim 2, wherein the second fastening member is comprised of at least two separate fastening members evenly distributed across the second end of the float section.

13. The bracing assembly of claim 2, wherein the one or more lightweight materials are selected from the group consisting of plastics, composite materials and combinations thereof.

14. The bracing assembly of claim 2, wherein the float section comprises one or more filler materials.

15. The bracing assembly of claim 1, wherein each of the bracing members is radially oriented from the first fastening member.

16. The bracing assembly of claim 1, wherein the first fastening member is attached to a first end of the float section and the second fastening members are member is attached to a second end of the float section.

17. The bracing assembly of claim 16, wherein the point of attachment of the first fastening member along the float section is adjustable from a first position to a second position.

18. The bracing assembly of claim 1, wherein the point of attachment of the first fastening member along the float section is adjustable from a first position to at least a second position.

19. The bracing assembly of claim 1, wherein the first fastening member further comprises one or more mooring eye assemblies attached to the first fastening member and including one or more mooring attachment points.

20. The bracing assembly of claim 19, wherein the one or more mooring attachment points are adjustable.

21. The bracing assembly of claim 20, wherein the one or more mooring attachment points are located upstream of the vertical axis of the buoy in marine conditions where a current is greater than zero.

22. The bracing assembly of claim 1, wherein the bracing members are selected from the group consisting of circular rods, semi-circular rods, multi-side rods and combinations of flat sided and curved sided rods.

23. The bracing assembly of claim 1, wherein the buoy comprises an overall height above the waterline of about 3 to about 5 meters.

24. A marine buoy comprising:

a float section;

a bracing assembly within the float section, the bracing assembly including a plurality of bracing members, a first fastening member attached to a first end of the float section, and separate fastening members attached to a second end of the float section;

the first end of each bracing member being configured to attach to the first fastening member and the second end of each bracing member being configured to attach to a second fastening member;

wherein the first fastening member is adapted to be positioned at a position along the first end of the buoy.

25. The buoy of claim 24, wherein the float section is constructed of one or more lightweight materials.

26. The buoy of claim 25, wherein each of the bracing members is radially oriented from the first fastening member.

27. The buoy of claim 26, wherein the float section comprises one or more filler materials.

28. The buoy of claim 25, wherein the attachment point of each bracing member to the first fastening member is closer to the vertical axis of the buoy than the attachment point of each bracing member to the second fastening members.

29. The buoy of claim 28, wherein the ends of each bracing member terminate at a point beyond the float section.

30. The buoy of claim 25, wherein the float section comprises at least one skin including a substantially uniform thickness from about 6.0 mm to about 18 mm.

31. The buoy of claim 25, wherein the float section comprises at least one skin including a substantially uniform thickness of about 9.0 mm.

32. The buoy of claim 25, wherein the one or more lightweight materials are selected from the group consisting of plastics, composite materials and combinations thereof.

33. The buoy of claim 32, wherein the plastic is selected from the group consisting of polyethylene, polypropylene, polyurethane and combinations thereof.

34. The buoy of claim 32, wherein the plastic is a UV-stabilized polyethylene.

35. The buoy of claim 32, wherein the composite material is selected from the group consisting of fiberglass reinforced polyester, fiberglass reinforced epoxy, aramid fibers, and carbon fiber composites.

36. The buoy of claim 24, wherein the first fastening member further comprises a mooring eye assembly.

37. The buoy of claim 24, wherein the bracing members are made from materials selected from the group consisting of metals, composite materials and combinations thereof.

38. A method for distributing stress placed upon a second end of a float section of a marine buoy, the method comprising the following steps:

providing a bracing assembly including a plurality of bracing members, a first fastening member, and separate second fastening members for distributing stress across a second end of a float section of a marine buoy;

attaching the separate second fastening members at various points along the second end of the float section; and attaching the first fastening member at a point along the first end of the float section closer to the vertical axis of the buoy than the attachment point of the second fastening members along the second end of the float section whereby each of the bracing members is radially oriented within the float section from the first fastening member to separate fastening members.

39. The method of claim 38, further comprising distributing the second fastening members across the second end of the float section.

40. The method of claim 39, further comprising increasing the surface area of the second fastening members as the stress placed upon the float section increases.

41. A method of securing a mooring eye assembly and a plurality of lifting eye assemblies to a float section of a marine buoy, the method comprising the steps of:

providing a bracing assembly including a plurality of bracing members within the float section, a first fastening member including a mooring eye assembly attached to a first end of the float section, and second fastening members each including a lifting eye assembly attached to a second end of the float section, wherein the first fastening member is attached to the first end of the float section at a point closer to the vertical axis of the buoy than the attachment point of each second fastening member to the second end of the float section;

attaching a first end of each bracing member to the mooring eye assembly; and attaching a second end of each bracing member to a separate lifting eye assembly.

42. The method of claim 41, further comprising distributing the separate fastening members across the second end of the float section.

43. The method of claim 41, further comprising positioning the first fastening member upstream of the vertical axis of the buoy from about one sixth to about one fourth of the diameter of the float section.

44. A large marine buoy comprising:

a float section constructed of UV-stabilized polyethylene;

a filler material forming a core within the float section;

a plurality of threaded rods radially oriented within the float section from a first end of the float section to a second end of the float section;

a first fastening member attached to a ballast surface of the float section; and a plurality of second fastening members attached to a deck of the float section;

wherein each of the threaded rods is configured to fasten to the first fastening member at a first end and configured to fasten to a second fastening member at a second end.

45. A marine buoy comprising:

a bracing assembly disposed within a core of said marine buoy;

said bracing assembly featuring a plurality of bracing members extending between and connecting to a first fastening member at one end of the buoy and a second fastening member at another end of the buoy;

wherein the attachment point of each bracing member to the first fastening member is closer to a vertical axis of the buoy than the attachment point of each bracing member to the second fastening member.

46. The marine buoy of claim 45, wherein said bracing members are from any of the group consisting essentially of either rods, wires, or cables.

47. The marine buoy of claim 45, wherein said bracing assembly defines an inverted cone or pyramid.

48. The marine buoy of claim 45, wherein said bracing members define an angle relative to a vertical axis of the buoy in the range from about 20 to about 80 degrees.

49. The marine buoy of claim 45, further comprising construction with lightweight materials.

50. The marine buoy of claim 45, further comprising a filler material surrounded by a skin.

51. The marine buoy of claim 45, wherein said buoy is a large buoy.

52. The marine buoy of claim 45, wherein said buoy is large, being at least 1.75 meters or greater in diameter.

53. The marine buoy of claim 45, wherein said buoy is large, having an overall height of at least 2.00 meters.

54. The marine buoy of claim 45, wherein said buoy has an overall height in the range of about 3 to about 7 meters.

55. The marine buoy of claim 45, wherein said buoy has a gross weight in the range of about 400 to about 3000 kilograms.

56. The marine buoy of claim 45, wherein said buoy has a maximum diameter in the range of about 1.75 to about 3.0 meters.

57. A bracing assembly for a float section of a marine navigation buoy comprising:

a plurality of bracing members within the float section;

a first fastening member at one end of the float section;

at least one second fastening member at another end of the float section;

wherein a first end of each bracing member is attached to the first fastening member and a second end of each bracing member is attached to a second fastening member; and wherein the point of attachment of the first fastening member along the float section is adjustable from a first position to at least a second position.

58. A bracing assembly for a float section of a marine navigation buoy comprising:

a plurality of bracing members within the float section;

a first fastening member at one end of the float section;

at least one second fastening member at another end of the float section;

wherein a first end of each bracing member is attached to the first fastening member and a second end of each bracing member is attached to a second fastening member; and wherein the first fastening member further comprises one or more mooring eye assemblies attached to the first fastening member and including one or more mooring attachment points.

59. A bracing assembly for a float section of a marine navigation buoy comprising:

a plurality of bracing members within the float section;

a first fastening member at one end of the float section;

at least one second fastening member at another end of the float section;

wherein a first end of each bracing member is attached to the first fastening member and a second end of each bracing member is attached to a second fastening member;

wherein at least the float section is constructed of one or more lightweight materials; and wherein the separate fastening members are evenly distributed across the second end of the float section.

* * * * *